United States Patent [19]

Byars et al.

[11] 3,965,707

[45] June 29, 1976

[54] LOCKING STRUCTURE

[75] Inventors: Gordon F. Byars, Stanton; Arthur L. Fairbanks, Fullerton, both of Calif.

[73] Assignee: Security Storage Rentals, Inc., Stanton, Calif.

[22] Filed: Mar. 6, 1975

[21] Appl. No.: 555,970

[52] U.S. Cl. ..... 70/120; 312/216

[51] Int. Cl.[2] ..... E05B 63/14; E05B 65/46

[58] Field of Search ..... 70/81, 82, 83, 84, 210, 70/211, 371, 417, DIG. 11, DIG. 43; 312/216, 333

[56] References Cited

UNITED STATES PATENTS

| | | | |
|---|---|---|---|
| 2,073,109 | 3/1937 | Kirkwood | 70/134 |
| 3,591,219 | 7/1971 | Graziosi | 292/207 |

*Primary Examiner*—Paul R. Gilliam
*Assistant Examiner*—C. F. Pietruszka
*Attorney, Agent, or Firm*—Edward D. O'Brian

[57] ABSTRACT

A locking structure for use with a door equipped with a latching member capable of being linearly moved in latching and unlatching the door can be constructed so as to utilize a control part secured to the latching member. Openings are provided in the control part and in the door in positions in which these openings are aligned when the latching member is in a latched position. A lock mechanism including an end flange may be inserted through the openings when they are aligned so that the flange fits against the exterior of the door. This lock mechanism includes a movable retainer which can be moved by appropriate actuation of the lock mechanism so as to extend outwardly from the locking mechanism in such a manner as to engage the control part. When this retainer engages the control part the locking mechanism is secured in place in such a manner that the latching member cannot be moved so as to unlatch the door. A protective structure is preferably used on the door around the opening within the door. A socket like holder is preferably secured to the door so as to facilitate positioning of the control part in a position in which the openings are aligned.

3 Claims, 4 Drawing Figures

LOCKING STRUCTURE

BACKGROUND OF THE INVENTION

The invention set forth in this specification pertains to new and improved locking structures, and more specifically to locking structures for use in securing a door or similar structure in a closed position with an essentially conventional type of cylindrical lock or lock mechanism.

There are many different types of locks or lock mechanisms which have been known and used. Most frequently they are constructed so as to include a cylindrical housing or barrel which is used to hold and retain lock elements such as, for example, a known tumbler mechanism capable of being actuated by a key or a dial operated combination lock mechanism. When such a mechanism is appropriately actuated a retainer rotatably mounted on the housing is normally moved with respect to the housing so as to accomplish a latching or an unlatching function.

Such conventional locks or lock mechanisms are normally installed in a door or similar structure in such a manner as to permit access to the end of the housing through which a key must be inserted or the end of the housing carrying a dial in a combination type lock. As they are so installed such conventional locks are relatively exposed. In such locations they are apt to be damaged and/or rendered wholly or partially inoperative by ambient influences such as inclement weather. It has long been recognized that the effects of such ambient conditions can be minimized by covering the exposed surfaces of such locks or lock mechanisms with an appropriate barrier or cover plate capable of being easily moved to gain access to a lock itself.

While expedients of this type are unquestionably effective they do not in fact provide a desired degree of protection against what may be considered to be the arsenal of equipment available to many thieves. Many comparatively unsophisticated thieves will utilize brute force type hand tools to render a lock or lock mechanism as described inoperative. When the face of such a mechanism is exposed or reasonably exposed frequently such a mechanism can be disabled and/or disassembled through the application of due force through a sledge hammer to an appropriate chisel-type instrument. Occasionally hand operated drills and other common tools are even utilized on locks and lock mechanisms as described.

However, at the present time thieves frequently do not utilize such essentially laborious methods of overcoming conventional locks and lock mechanisms as described. Thus, for example, it is common place for thieves to utilize commercially available battery operated portable drills with conventional drill bits such as are normally sold for home use in rendering locks or lock mechanisms inoperative. Frequently such individuals will also utilize appropriate cutting torches for this purpose. On occasion conventional lock picking implements will be utilized in breaking into conventional locks or lock mechanisms. In general, however, the use of such picking tools is avoided because of the legal consequences of possessing such tools and/or the possible presumption that any individual owning such tools has used them or intends to use them improperly.

All of these factors have tended to make the use of conventional locks or lock mechanisms as described in the preceding undesirable. It has been recognized that one way of avoiding the relative ease by which such locks or mechanisms can be rendered inoperative would be to utilize specially formed locks or lock mechanisms which are relatively resistant to all of the methods of thievery indicated in the preceding discussion. From an economic standpoint, however, such use of what may be regarded as "better" locks or lock mechanisms is undesirable. In general, the less expensive the lock or lock mechanism used in a particular application is consistent with the degree of protection against undesired entry desired the better.

Hence, it is considered that there is a need for new and improved locking structures for use with conventional relatively inexpensive locks or lock mechanisms as described which will enable such locks or lock mechanisms to be utilized in order to achieve a greater degree of resistance to thievery than it has been previously possible to achieve using these same locks and lock mechanisms. It is considered that this need is particularly significant in connection with doors such as are used on storage containers and the like which are normally located where they are not often inspected.

SUMMARY OF THE INVENTION

A broad object of the present invention is to provide new and improved locking structures to meet the need indicated in the preceding discussion. A related object of the present invention is to provide locking structures which may be easily and conveniently constructed at a comparatively nominal cost and which, when used with conventional locks or lock mechanisms as described, are capable of rendering such locks and lock mechanisms significantly difficult to break open. A further objective of the present invention is to provide a simple lock structure of the type indicated which is integral with a door such as a door for a storage shed, a trailer or the like and which utilizes a part of the latch mechanism normally incorporated within such a door.

In accordance with this invention these objectives are achieved by providing a locking structure for use with a door equipped with a latching member capable of being moved between a latched and an unlatched position which comprises: a control part secured to the latching member so as to extend therefrom adjacent to the rear surface of the door when the latching member is in the latched position, these openings being capable of receiving a lock mechanism or means provided with an elongated housing, a flange on one end of the housing and a movable retainer on the other end of the housing, this lock mechanism being capable of being fitted so that the housing extends through the openings in the door and the control part with the flange in engagement with the front surface of the door and with the retainer extending outwardly in engagement with the control part so as to prevent removal of the lock means from the door and the control part.

A lock structure of the present invention is preferably more involved than this summary would indicate. Such a lock structure is intended to be used with a protective shield mounted on the door extending around the lock mechanism or means. Preferably the door includes a socket-like holder which facilitates positioning of the control part so that the openings are aligned. Further, the entire structure is preferably manufactured out of comparatively massive pieces of metal so as to make it extremely difficult to break into the structure by rendering the locking mechanism or means inoperative.

BRIEF DESCRIPTION OF THE DRAWING

The invention is best more fully delineated with reference to the accompanying drawing in which.

Figure 1:
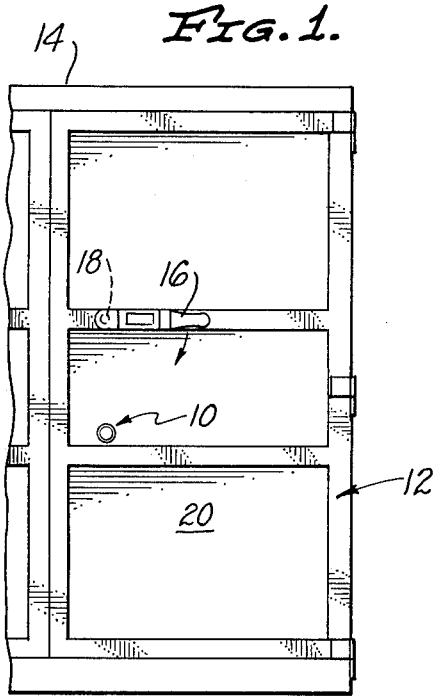
FIG. 1 is a front elevational view of a part of a storage shed having a door equipped with a presently preferred embodiment or form of a locking structure in accordance with this invention.

The structure illustrated in the drawing embodies certain essentially intangible concepts as are set forth and defined in the appended claims. It is possible to utilize these concepts in various somewhat differently appearing and differently constructed locking structures through the use or exercise of routine engineering skill. It is contemplated that various routine engineering changes will be made by various individuals constructing locking structures in accordance with this invention.

DETAILED DESCRIPTION

In the drawing there is shown a locking structure 10 in accordance with this invention installed upon a door 12 of a conventional metal storage shed 14. The invention set forth herein is not directed toward any particular type of door on any particular type of structure. However, it is considered that a locking structure 10 of this invention is particularly desirable for use in connection with metal storage sheds or metal shipping containers which are left unattended for relatively prolonged periods.

The door 12 is equipped with a conventional handle 16 secured to a shaft 18 mounted upon the door 12 in such a manner as to be capable of being rotated upon its axis. This handle 16 is located on the front surface 20 of the door 12. An elongated arm or lever 22 is located on the shaft 18 adjacent to the rear surface 24 of the door 12. Holes 26 in this lever 22 carry ends 28 of latching members 30 in such a manner that these ends 28 can pivot slightly relative to the lever 22 as the lever 22 is turned through rotation of the handle 16. The extremities (not shown) of the latching members 30 remote from the lever 22 are normally guided by brackets (not shown) so as to move into and out of holes or brackets (not shown) on the shed 14 adjacent to the door 12.

This structure involving the handle 16, the shaft 18, the lever 22, and the latching members 30 is commonly utilized in connection with many types of doors. The invention set forth herein is primarily concerned with rendering this type of latching structure relatively immune to thievery through the use of a comparatively simple, inexpensive commercially available lock mechanism 32. This particular mechanism 32 includes an elongated cylindrical housing 34 which is provided with a peripheral exterior flange 36 at one of its ends 38. This mechanism 32 illustrated includes a conventional tumbler type lock assembly 40 which is adapted to receive a key 42. When the key 42 is actuated a retainer 44 carried by the lock assembly 40 at the other end 46 can be moved so as to either overlie this end 46 or so as to extend outwardly from it more or less radially. Other known lock mechanisms may be employed.

The locking structure 10 of the present invention is intended to be located within an opening 48 in the door 12. It includes a centrally located, comparatively massive steel plate 50 provided with a centrally located opening 52. A cylindrical, comparatively massive steel shield 54 is attached to the plate 50 so as to extend through the opening 48 out past the front surface 20 of the door 12. This shield 54 preferably includes a threaded end 56 which is adapted to carry an externally threaded closure 58 such as a conventional pipe plug. The plate 50 also carries a massive steel socket like holder 60 consisting of two side walls 62 connected by a back wall 64 which is spaced from the plate 50. This holder 60 is located in a position so that it can receive a steel control part 66 carried by a latching member 30 when the handle 16 of the door 12 is moved to a closed or latched position.

This holder 60, however, is shaped so as to permit the control part 66 to be removed from it as the latching members 30 are moved to an unlatched position by appropriate actuation of the handle 16. This control part 66 includes a centrally located opening 68 of the same dimension as the opening 52. These openings 52 and 68 are located so as to be aligned with one another when the latching members 30 are in a latched position. The control part 66 also preferably carries a cylindrical wall 70 which in turn carries an end wall 72. A slot 74 is provided in the wall 70 adjacent to the wall 72 so as to accommodate the retainer 44 when this retainer 44 extends generally outwardly from the lock mechanism 32.

The use of the locking structure 10 is essentially rather simple. When this locking structure 10 is to be used the closure 58 is unthreaded from the shield 54 in a conventional manner. This allows very restricted access to the mechanism 32 so that the key 42 may be inserted and actuated in a conventional manner so as to either move the retainer 44 outwardly from the end 46 or so as to move the retainer 44 so that it overlies this end 46. When the retainer 44 overlies the end 46 the entire locking mechanism 32 may be withdrawn from the door 12 through the shield 54 to a sufficient extent so that there is no engagement with the control part 66. At this point the handle 16 may be actuated in a conventional manner in order to move the latching members 30.

Figure 2:
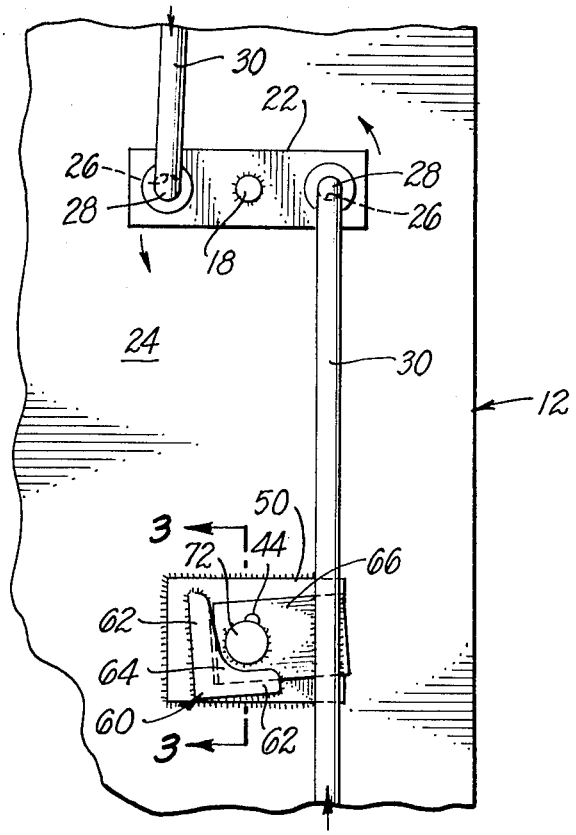
FIG. 2 is a partial rear elevational view of this door.
Figure 3:
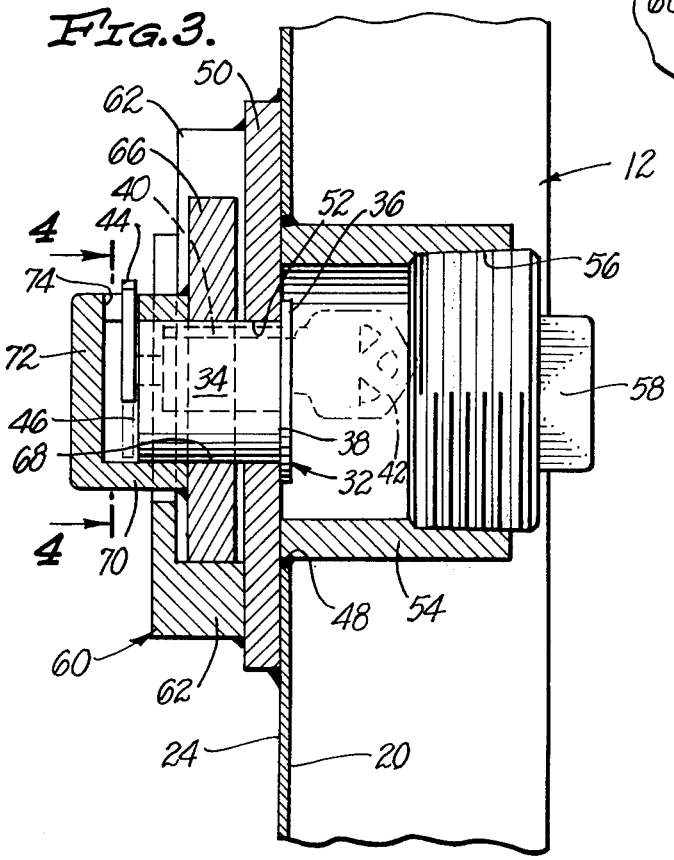
FIG. 3 is a partial cross-sectional view taken at line 3—3 of FIG. 2.
Figure 4:
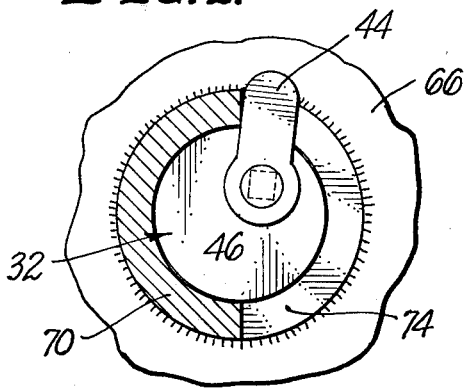
FIG. 4 is a partial cross-sectional view taken at line 4—4 of FIG. 3.

When the door 12 is to be locked utilizing the locking structure 10 the handle 16 will be actuated so as to move the latching members 30 to a position in which the openings 52 and 68 are aligned. The holder 60 is very desirable in this since it engages the control part 66 in such a manner as to support the control part 66 in a position in which the openings 52 and 68 are aligned. When the control part 66 is in such a position the mechanism 32 may be inserted and actuated so as to move the retainer 44 to a position as shown in FIGS. 2, 3 and 4 in which it effectively engages the control part 66 in order to prevent movement of the handle 16.

Although this locking structure 10 is comparatively simple it is extremely desirable from a utilitarian standpoint. The shield 54 is sufficiently long so as to tend to minimize the ability of a thief to utilize most lock picking equipment with the assembly 40. Further, this shield 54 blocks direct access to the lock mechanism 30 in such a manner as to effectively preclude the use of most hand tools against this mechanism 32. Further, this shield 54 is preferably longer than conveniently purchased drill bits for use with battery powered electric drills. This minimizes the chances of a thief breaking in utilizing such drills to gain access.

Further, all parts of the locking structure 10 except the mechanism 32 are preferably in such massive or thick dimension as to tend to act as a "heat sink". This is considered to be important in preventing the use of conventional portable cutting and welding equipment in breaking into the locking structure 10. This is accomplished because the massive quantities of metal used will tend to conduct heat away from any area heated by a gas torch sufficiently rapidly so as to minimize the chances of there ever being a sufficient heat buildup to permit the cutting open of the structure 10 illustrated with portable welding or cutting equipment of a type apt to be carried by a thief.

We claim:

1. A locking structure for use with a door equipped with a latching member which is capable of being moved between a latched and an unlatched position which comprises:

a control part secured to said latching member so as to extend therefrom adjacent to the rear surface of said door when said latching member is in said latched position, said control part and said door being provided with openings which are aligned when said latching member is in said latched position and which are unaligned when said latching member is in said unlatched position, a lock means having an elongated housing, a flange on one end of said housing and a movable retainer on the other end of said housing, said lock means being capable of being actuated so that said retainer either extends from said other end of said housing or overlies said other end of said housing, said openings and said lock means being of such a dimension that said lock means may be inserted through both of said openings so that said flange abuts against the front surface of said door, said lock means being capable of being actuated when inserted through said opening so that said retainer extends from said housing and engages said control part so as to prevent relative movement between said control part and said door, a plate forming a part of said locking structure secured to said door, said opening in said door being located in said plate, a shield located on said plate and extending from said plate outwardly from the front surface of said door, said shield surrounding said opening in said plate and extending outwardly from said plate so as to restrict access to said lock means when said lock means is in place in said opening in said plate and said control part.

2. A locking structure as claimed in claim 1 wherein:

said shield and said plate are sufficiently massive so as to be capable of acting as a heat sink means for preventing the buildup of heat from a cutting torch sufficient to render said locking structure inoperative for its intended utilization.

3. A locking structure as claimed in claim 1 including:

socket means located on the rear surface of said door, said socket member being capable of receiving said control part when said latching member is moved from said unlatched position to said latched position so as to hold said control part in a position in which said openings are aligned with one another, said shield, said socket, said plate and said control part being of such dimension and of such proximity to one another so as to be capable of acting as a heat sink means for limiting the heat buildup when heat is applied to said locking structure to an extent sufficient to enable said locking structure to be opened.

* * * * *